US005921426A

United States Patent [19]

Randolph

[11] Patent Number: 5,921,426

[45] Date of Patent: Jul. 13, 1999

[54] LINER HOLDER

[75] Inventor: Ross Steven Randolph, Rockaway, N.J.

[73] Assignee: Playtex Products, Inc., Westport, Conn.

[21] Appl. No.: 08/779,182

[22] Filed: Jan. 6, 1997

Related U.S. Application Data

[51] Int. Cl.[6] ..... B65D 35/14; B65D 37/00; A61J 9/04; A61J 9/06

[52] U.S. Cl. ..... 220/495.06; 215/11.3; 215/11.6; 215/900; 222/105

[58] Field of Search ..... 215/11.1, 11.3, 215/11.6, 12.1, 396, 900; 220/462, 495.06; 222/105

[56] References Cited

U.S. PATENT DOCUMENTS

| | | | |
|---|---|---|---|
| 2,321,236 | 6/1943 | Parkin . | |
| 2,329,917 | 9/1943 | Lautmann . | |
| 2,826,324 | 3/1958 | Hoag | 215/11.3 |
| 2,907,485 | 10/1959 | Lunden . | |
| 3,395,822 | 8/1968 | Donleavy | 215/11.3 |
| 3,521,807 | 7/1970 | Weisberg | 220/462 X |
| 3,955,698 | 5/1976 | Hammer . | |
| 3,998,348 | 12/1976 | Sammaritano . | |
| 4,098,434 | 7/1978 | Uhlig | 222/105 X |
| 4,176,754 | 12/1979 | Miller . | |
| 4,558,792 | 12/1985 | Cabernoch et al. | 215/11.3 |
| 4,730,744 | 3/1988 | Vinciguerra . | |
| 4,796,767 | 1/1989 | McKeown . | |
| 4,813,556 | 3/1989 | Lawrence | 215/11.1 X |
| 4,816,093 | 3/1989 | Robbins, III | 215/12.1 X |
| 4,909,416 | 3/1990 | Evezich | 222/105 X |
| 4,944,418 | 7/1990 | Wallace | 215/11.3 X |
| 5,027,963 | 7/1991 | Robbins, III | 215/396 X |
| 5,098,095 | 3/1992 | Weiss . | |
| 5,115,948 | 5/1992 | Johnson . | |
| 5,215,229 | 6/1993 | Johnson . | |
| 5,301,825 | 4/1994 | Di Scala et al. | 215/11.3 X |
| 5,318,204 | 6/1994 | Davis et al. | 222/105 X |
| 5,356,016 | 10/1994 | Wiedemann | 215/11.3 |
| 5,687,861 | 11/1997 | Wiedemann | 215/11.3 |

*Primary Examiner*—Sue A. Weaver
*Attorney, Agent, or Firm*—Ohlandt, Greeley, Ruggiero & Perle, L.L.P.

[57] ABSTRACT

A holder, for use with disposable baby feeding liners, includes a body having a plurality of walls. The walls form at least one pair of opposed walls that are adapted to be compressed to press against a liner contained within the holder to expel air from the liner. In another embodiment, each wall of at least one pair of opposed walls has a wall portion that is adapted to be compressed to press against the liner. In either embodiment, the bottom of the holder is either opened or is a surface having at least one air vent therethrough.

33 Claims, 3 Drawing Sheets

LINER HOLDER

The present invention relates to a holder for dispensing baby formula and the like. More particularly, this invention relates to a holder for use with a disposable liner or sac which holder has at least one pair of walls that can squeeze against the walls of the liner contained therein in order to apply pressure to the liner. In a second embodiment, the holder has at least one pair of side walls each wall having an area that can be squeezed against the walls of the liner. The holder can have either a bottom having at least one air vent therethrough or an open bottom.

BACKGROUND OF THE INVENTION

Reusable baby bottles or hard bottles, such as made of glass or plastic, have been commonly used to feed babies formula, water, and other liquids. After liquid is placed in the bottle, a nipple is attached to the bottle and the assembly is ready for use. A hard bottle sometimes is cleaned and sterilized between each use, requiring substantial time and effort.

An alternative to a hard bottle is the disposable liner or sac (also referred to as a "disposable bottle") that is used in conjunction with a holder which supports the liner. The liner, which is mostly used only once, is pre-sterilized, and is inserted into the holder. The liner is then filled with liquid, and a nipple is attached to the holder. This alternative is economical and sanitary, and greatly minimizes the time and effort required to prepare for feeding a baby.

One limitation inherent in hard bottles is the tendency of babies to ingest substantial amounts of air when ingesting the liquid. This air can cause uncomfortable distention and gas in the baby's stomach, and may lead to vomiting and other problems. Disposable liners collapse as liquid is drawn out, thus minimizing the amount of air the baby ingests. However, under some circumstances a small amount of air is in the headspace above the liquid fill or can be drawn into the liner through the hole of the nipple when the baby is not feeding.

Attempts have been made to address this problem. U.S. Pat. No. 3,998,348 to Sammaritano provides a roller assembly attached to the lower, closed end of the liner to take pp the liner as it empties. U.S. Pat. No. 4,796,767 provides a pushrod stored on the outside of the holder. When in use, the pushrod is inserted through the open bottom of the holder to press air out of the liner through the attached nipple feeding hole. U.S. Pat. No. 4,176,754 to Miller provides a donut-shaped pneumatic roller used to press air out of the liner as discussed above.

Some patents provide a plunger-type insert having the general shape of the inside of the holder. The plunger can be pushed up within the holder to press air out of the liner. Certain devices use a plunger having a stem extending from the open bottom of the holder. Other devices require the user to reach inside the open bottom of the holder to operate the plunger.

Other patents provide a refinement on this construction employing a plunger-type insert that is operable by means located on the sides of the holder. U.S. Pat. No. 5,356,016 to Wiedemann provides a flat, circular plunger member having a pair of tab handles on its diameter that extend through a pair of longitudinal slots in the holder.

U.S. Pat. No. 3,955,698 to Hammer is a device somewhat similar to that shown in the Wiedemann patent. However, the Hammer device has a pair of tab handles that engage with ratcheted indentations on the interior surface of the holder. U.S. Pat. No. 5,301,825 to Di Scala et al. provides a related device in which the tab handles are connected in a ring extending around the holder.

All of these devices need additional parts. Also, the early devices appear to be unwieldy, unstable or awkward. The three latter devices require a complex disassembly of the tab or ring handles to clean the holder assembly. This is inconvenient and time-consuming for the user. Also, the devices with small tab handles are removable, and can pose a danger to the baby as small parts. In addition, each device requires two hands to operate properly. Furthermore, each device is bulky thereby making these known devices less attractive and, presumably, more expensive to make.

SUMMARY OF THE INVENTION

Against the foregoing background, it is a primary object of the present invention to provide a holder that provides for efficient expulsion of air from a disposable liner or a preformed sac.

It is another object of the present invention to provide such a holder that allows air removal from the liner, and can be held and operated effectively and easily with one hand by the user.

It is a further object of the present invention to provide such a holder that is easy to clean.

To the accomplishment of the foregoing objects and advantages, the present invention, in brief summary, comprises a holder for a disposable liner. The holder has a body having an open top, a bottom and a plurality of walls between the top and the bottom. The plurality of walls are preferably arcuate in shape, and form at least one pair of opposed walls. In a preferred embodiment, two pairs of opposed walls are formed. The second pair of opposed walls is relatively rigid, while the first pair of opposed walls is very flexible so that they can be squeezed together by one hand of the user against the walls of the liner therein. It is preferred that each of the first pair of opposed walls is relatively thin as compared to each of second pair of opposed walls, and as compared to conventional holder walls. The bottom can have either a surface with at least one air vent for passing air from and into the holder, or is virtually entirely opened.

In another embodiment, the holder has an open top, a bottom and a plurality of walls between the top and the bottom. The plurality of side walls are again preferably arcuate in shape, and preferably form at least one pair of opposed walls. Each wall of the one pair of opposed walls has an area in which the wall is flexible so that the areas can squeeze together by one hand of the user against the walls of the liner therein. Again, the bottom can have either a surface with at least one air vent for passing air from and into the holder, or is virtually entirely opened.

In all embodiments, the walls or areas of the walls are so flexible that they can virtually be squeezed together by one hand of the user even if the liner contained therein has a minimal amount or is absent any liquid.

DESCRIPTION OF THE PREFERRED EMBODIMENTS

Figure 1:
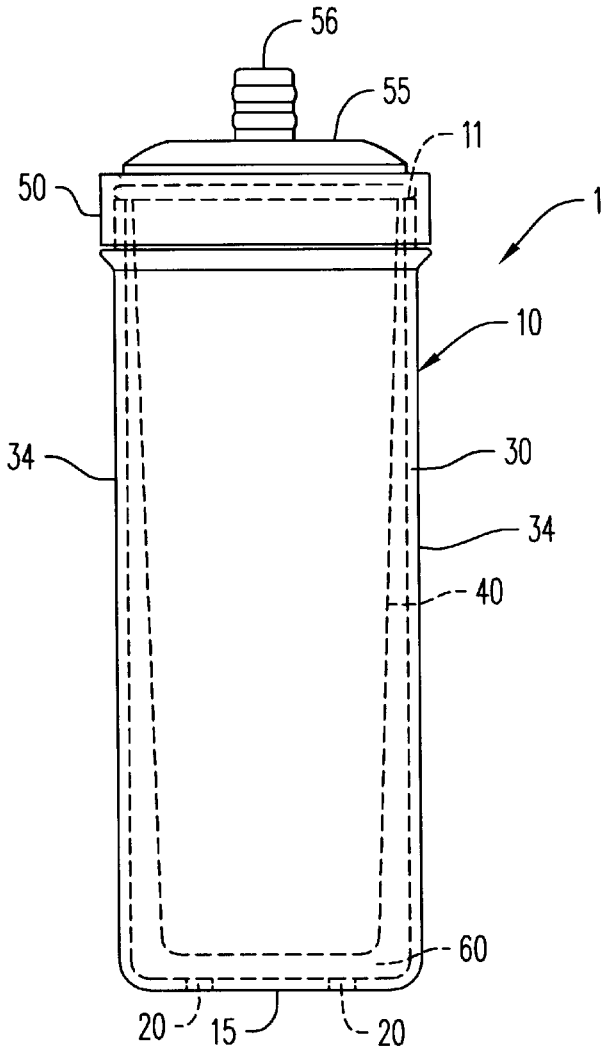
FIG. 1 is a plan view of a first embodiment of the holder of the present invention, with a nipple, retaining ring and liner.

Referring to the drawings and, in particular, FIG. 1, there is shown a holder according to the present invention generally represented by reference numeral 1. The holder 1 includes a body 10 having an upper, open surface with a rim 11, a bottom 15, and a plurality of walls 30. The holder 1 is adapted to hold a liner 40, and is adapted to receive a nipple retaining ring 50 and nipple 55.

The plurality of walls 30 are arcuate in shape, and preferably even in number. The plurality of walls 30 should have at least one pair of opposed walls or wall sections that are on opposite sides of the liner.

Figure 2:
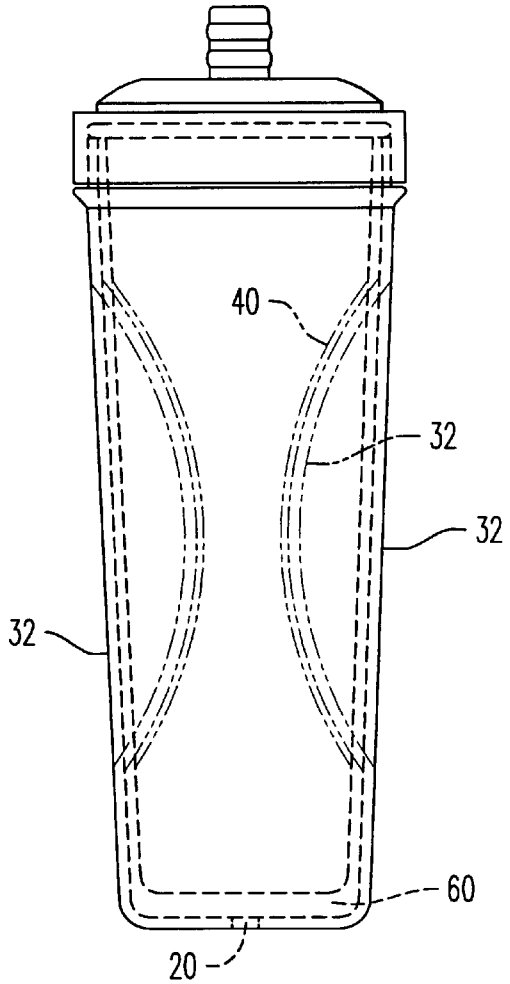
FIG. 2 is a view, ninety degrees with respect to FIG. 1, of the holder of FIG. 1.

In a preferred embodiment shown in FIGS. 1 and 2, the first pair of opposed walls 32 are integrally connected to a second pair of opposed walls 34. The opposed walls 32 are adapted to be compressed or squeezed towards each other and, thus, press against liner 40 that is contained within body 10. The opposed walls 32 are flexible enough to squeeze against liner 40 even when the liner is virtually free of liquid. The walls 34 are relatively more rigid than walls 32 to maintain the integrity of the holder 1 and the liner 40 therein, yet permit the squeezing together of the more flexible walls 32.

Each wall 32 can be made more flexible than each wall 34 in several different ways, namely the thickness of the wall, the material used to form the wall, the curvature or configuration of the wall including its cross-section and tapering, and any combination of these factors.

The walls 30 of the body 10 are made of a material that will not warp, will hold the liner in position therein, and permits walls 32 to be flexible so as to allow them to be continually pressed by a user against the liner in the holder. The walls 32 and 34 may be made of the same or different materials and/or the same or different wall thicknesses or any combination thereof. However, in order to provide the greater flexibility, each wall 32 should, preferably, be of a lesser thickness than each wall 34.

A holder for a normal disposable bottle normally has a wall thickness of about 0.060 inches to about 0.065 inches. In a preferred embodiment of the present invention, each wall 32 is about 0.015 inches to about 0.040 inches in thickness and more preferably about 0.020 inches to about 0.040 inches, while each wall 34 is preferably about 0.030 inches to about 0.040 inches in thickness. Thus, each wall 32 is relatively thin with respect to each wall 34.

It is preferred that each wall 32 be made of a flexible plastic material, such as, for example polyolefin, polyvinyl chloride, polyethylene terephthalate, thermoplastic elastomer, latex or synthetic latex. Each wall 34 can be formed of any one of the same materials as each wall 32 and, in addition, it can be made of other, more rigid materials. Also, in any particular embodiment, each wall 32 can be made of one material listed above, while each wall 34 can be made of another material listed above.

The arcuate or curved shape of a wall, whether convex or concave, is believed to facilitate flexing. Accordingly, the body 10 preferably has an oval cross-sectional shape (taken at ninety degrees to the vertical axis) since such a shape should facilitate squeezing or flexing of the walls 32 of the holder 1. Alternatively, the body 10 can have a cylindrical shape. Nonetheless, this invention also envisions that the walls 30 of the holder 1 can have any curvature or curved shape that will facilitate flexing.

It is also preferred that the body 10 of the holder 1 taper from the top to the bottom so that it has a slightly smaller diameter at the bottom. This feature should also facilitate flexing. As illustrated in FIG. 2, such a taper should follow the taper of the liner 40 so that it also has the advantage of minimizing the amount of air or space 60 between the liner and inside of the holder.

For all shapes, the rim 11 should maintain a circular shape in order to remain compatible with conventional nipple retaining rings 50 and nipples 55. Also, the open top, outer diameter at the threads of the body 10 is about 2.19 inches, and the open top, inside diameter is about 1.90 inches so that the body can readily receive a conventional disposable nipple retaining ring 50.

Figure 3:
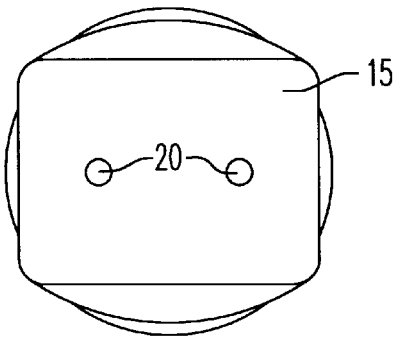
FIG. 3 is a bottom view of the holder of FIG. 1.

As shown in the embodiment FIGS. 1 through 3, the bottom 15 preferably has at least one air vent 20. As shown clearly in FIGS. 1 and 3, two air vents 20 are shown and believed preferred. In any event, more than two, namely multiple air vents 20, can be used. The air vents 20 permits air to freely exit and enter into holder 1 in space 60 between body 10 and liner 40. Each air vent 20 is preferably a circular hole in order to permit the unimpeded ingress and egress of air. Air vent 20 is unlike a one-way valve that permits movement of air in one direction or a two-way valve which would provide for ingress and egress of air, but in a metered or restricted manner. Furthermore, a valve may have a slower flow rate of air, and would be more costly to make and incorporate into the holder 1.

The holder 1 with bottom 15 is a preferred embodiment since it maintains integrity or strength to the holder. In addition, this embodiment avoids any pinch point between the liner 40 and the walls 30 of the holder 1. As shown in FIGS. 1 and 2, the bottom 15 of the holder has sufficient space between it and liner 40 to avoid any pinch point.

For use, a liner 40 is inserted into body 10 of holder 1. Liquid is poured into liner 40, and nipple retaining ring 50 having nipple 55 is affixed to rim 11 of the body 10, thus securing the liner in the holder. For operation, one squeezes opposed walls 32 towards each other so that these opposed walls are pressed firmly against the liner maintaining the pressure on the liner until all the air is purged through a nipple aperture 56 and a small amount of liquid is dispensed. By this movement, air is pushed out of liner 40 through nipple aperture 56. The air vent 20 allows air to exit from space 60. Yet sufficient air is allowed back into that space 60 through air vent 20 to prevent a negative pressure between the inside and outside of body 10 which could cause nipple 55 to invert. Squeezing the walls 32 when the baby is not feeding will prevent air from entering liner 40 through nipple aperture 56.

Figure 4:
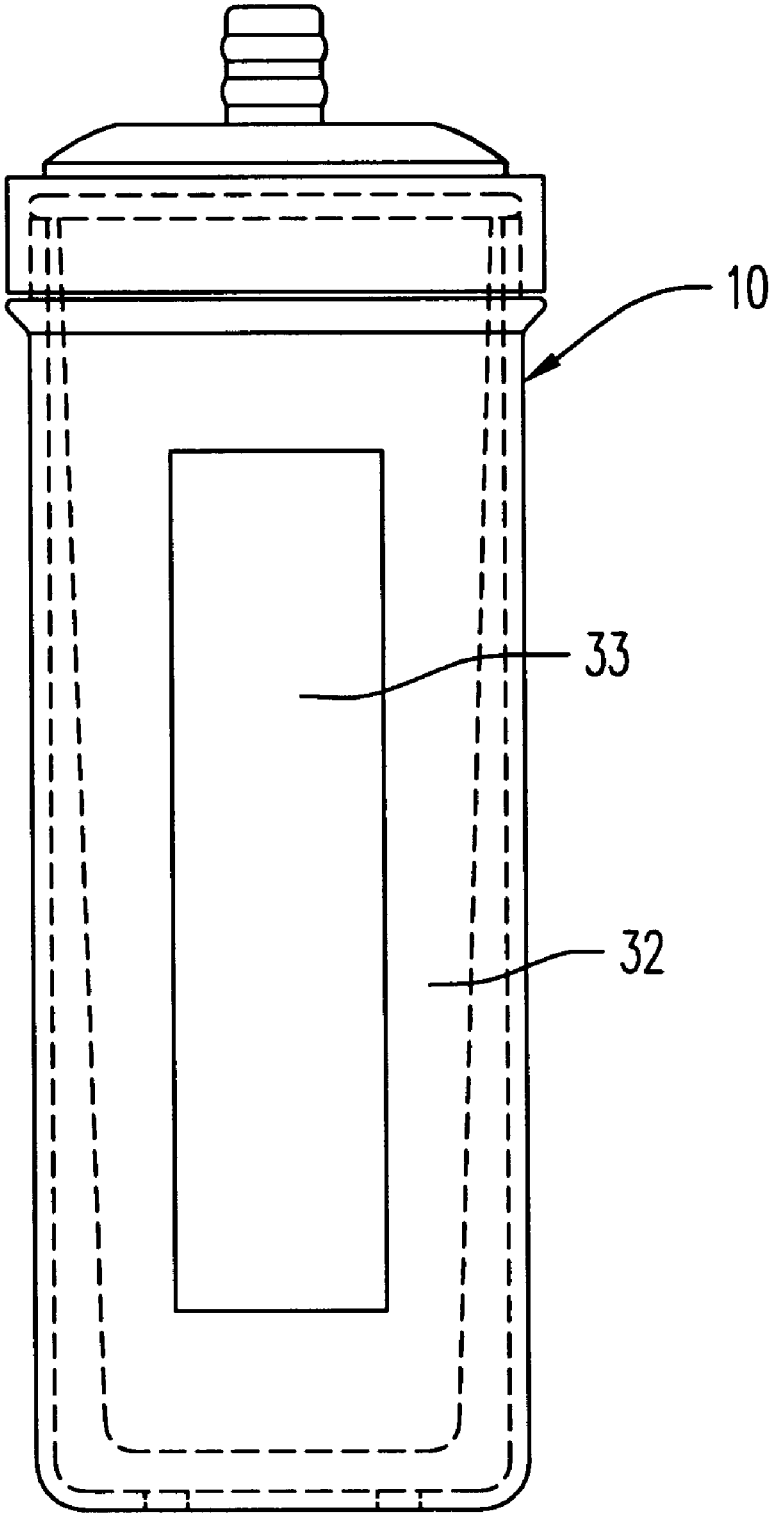
FIG. 4 is a plan view of a second embodiment of the holder of the present invention.

FIG. 4 illustrates a second embodiment of the present invention. The plurality of walls 30 have at least one pair of opposed walls 32 (only one of which is shown). Each wall 32 has an area for flexing or squeezing. The area can be an integral part of wall 32 or simply an open area in which a substrate or wall portion 33 is secured thereto. The area, and thus wall portion 33, can have any shape but preferably is along a portion of the axial extent of holder 1 in order to contact liner 40 along a significant portion of the liner's vertical or axial extent. The wall portion 33 is more flexible than the remainder of wall 32.

This increased flexibility can be achieved by the material, thickness or curvature of the wall portion or any combination thereof, and possibly even the material, thickness or curvature or any combination thereof of body 10 in combination with the wall portions 33. It is preferred that wall portion 33 have a thickness between about 0.015 inches to about 0.040 inches in thickness and more preferably about 0.015 inches.

As shown in FIG. 4, in this embodiment, body 10 has a bottom 15 with a surface that has at least one air vent 20 and, more preferably, at least two air vents therethrough.

Figure 5:
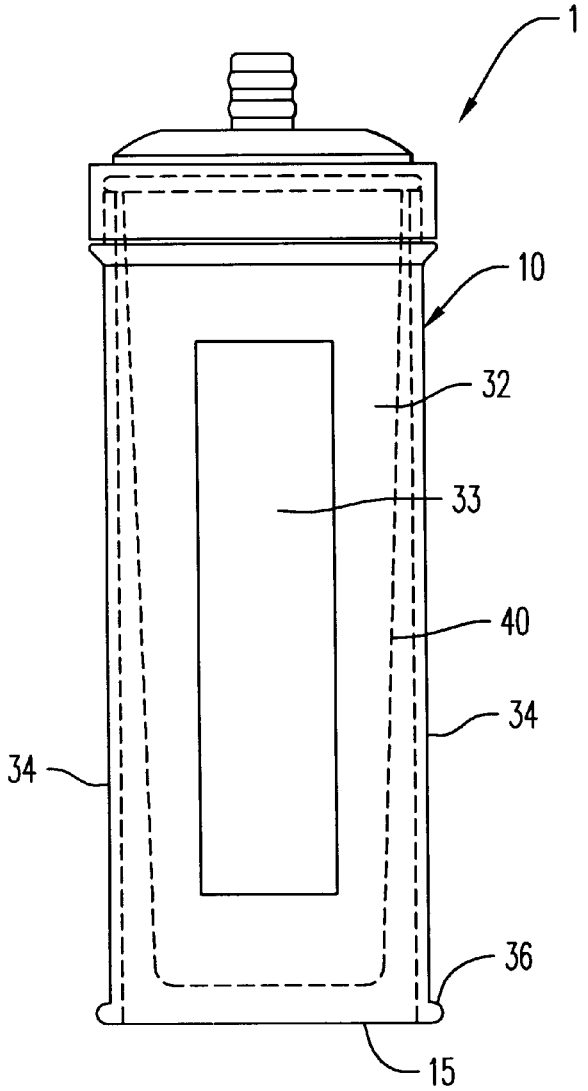
FIG. 5 is a plan view of a third embodiment of the holder of the present invention.
Figure 6:
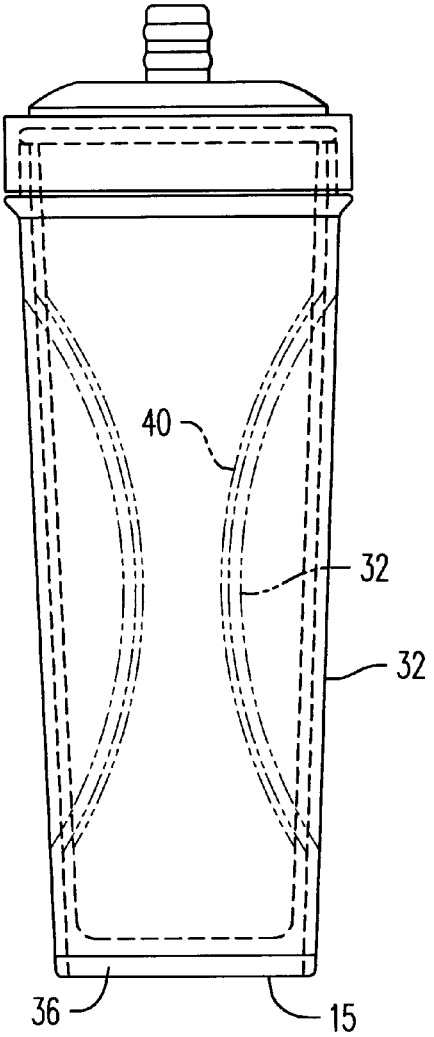
FIG. 6 is a plan view of a fourth embodiment of the holder of the present invention.

In the embodiment of FIGS. 1 through 3 and the embodiment of FIG. 4, bottom 15 has a surface with at least one air vent 20 therethrough. FIGS. 5 and 6 show an alterative bottom 15 to the two embodiments of FIG. 4 and FIGS. 1 through 3, respectively. The body 10 has an open top and an open bottom 15. With this open bottom 15, there is no need for an air vent. Also, the amount of force to compress opposed walls 32 or wall portions 33 may be less. However, opposed walls 34 may need to be thicker than walls 34 in the above embodiments in order to maintain the integrity and strength of the body 10 and permit the holder 1 to stand vertically or erect when not in use and filled with liquid. In this embodiment, the open bottom 15 of the holder 1 has a bead 36 that assists in maintaining the integrity of the holder. The bead 36 is preferably on each wall 34 and, optionally, all walls of the body 10.

The invention having been thus described with particular reference to the preferred forms thereof, it will be obvious that various changes and modifications may be made therein without departing from the spirit and scope of the invention as defined in the appended claims.

What I claim is:

1. A holder for a disposable liner, comprising:

a body for receiving the liner, said body having at least three side walls, a bottom and an open top, said bottom having at least one air vent for movement of air into and out of said body, said at least three side walls including at least one pair of opposed side walls, said at least one pair of opposed side walls being more flexible than other of said at least three side walls, wherein said at least one pair of opposed side walls can be flexed to compress against the liner to expel air from the liner, while said other of said at least three side walls, being relatively more rigid than said at least one pair of side walls, remains relatively non-flexed to maintain the strength of the holder.

2. The holder of claim 1, wherein said body has an arcuate shape.

3. The holder of claim 1, wherein said body has an oval shape.

4. The holder of claim 1, wherein said body has a cylindrical shape.

5. The holder of claim 1, wherein said at least three side walls is at least four side walls that include at least a first pair and a second pair of opposed side walls.

6. The holder of claim 5, wherein said first pair is relatively flexible with respect to a second pair in order to compress against the liner.

7. The holder of claim 5, wherein each wall of said first pair is made of a flexible plastic material.

8. The holder of claim 5, wherein each wall of said first pair is made of a material selected from the group consisting of polyolefin, polyvinyl chloride, polyethylene terephthalate, thermoplastic elastomer, latex and synthetic latex.

9. The holder of claim 5, wherein each wall of said second pair is about 0.030 inches to about 0.040 inches in thickness.

10. The holder of claim 5, wherein said first pair is thinner than said second pair.

11. The holder of claim 10, wherein each wall of said first pair is about 0.015 inches to about 0.040 inches in thickness.

12. The holder of claim 10, wherein each wall of said first pair is about 0.020 inches to about 0.040 inches in thickness.

13. The holder of claim 1, wherein said body is tapered from said open top to said bottom, so that said bottom has a smaller diameter than said open top.

14. A holder for a disposable liner, comprising:

a body for receiving the liner, said body having at least three side walls, a bottom and an open top, said at least three side walls including at least one pair of opposed side walls, each side wall of said at least one pair of opposed side walls having an isolated side wall section and a surrounding side wall section, wherein said isolated side wall section is more flexible than the surrounding side wall section, wherein each isolated side wall section of said at least one pair of opposed side walls can be flexed to compress against the liner to expel air from the liner, while the surrounding side wall sections of said at least one pair of opposed side walls, being relatively more rigid than said isolated side wall sections, remain relatively non-flexed to maintain the strength of the holder.

15. The holder of claim 14, wherein said bottom is a surface having at least one air vent for movement of air into and out of said body, and wherein said at least one air vent is a hole.

16. The holder of claim 15, wherein said at least one air vent is a pair of air vents.

17. The holder of claim 14, wherein said bottom is a virtually entirely open bottom.

18. The holder of claim 14, wherein each isolated side wall section is thinner than the its surrounding side wall section.

19. The holder of claim 14, wherein each wall portion is about 0.015 inches to about 0.040 inches in thickness.

20. The holder of claim 14, wherein said body has an arcuate shape.

21. A holder for a disposable liner, comprising:

a body for receiving the liner, said body being hollow and having a circular rim defining an open top, an open bottom, and at least three side walls, said at least three side walls including at least one pair of opposed side walls, said at least one pair of opposed side walls being more flexible than the other of said at least three side walls, wherein said at least one pair of opposed side walls can be flexed to compress against the liner to expel air from the liner, while said other of said at least three side walls, being relatively more rigid than said at least one pair of side walls, remains relatively non-flexed to maintain the strength of the holder.

22. The holder of claim 21, wherein said at least three side walls is at least four side walls that include at least a first pair and a second pair of said opposed side walls.

23. The holder of claim 22, wherein said first pair is relatively flexible with respect to said second pair.

24. The holder of claim 22, wherein said first pair is thinner than said second pair.

25. The holder of claim 22, wherein each wall of said first pair is about 0.015 inches to about 0.040 inches in thickness.

26. The holder of claim 22, wherein each wall of said first pair is made of a flexible plastic material.

27. The holder of claim 21, wherein said body has an arcuate shape.

28. A holder for a disposable liner, comprising:

a body for receiving the liner, said body having a plurality of walls, a bottom and an open top, said bottom having at least one air vent for movement of air into and out of said body, said plurality of walls including at least two pairs of opposed side walls, a first pair of said at least two pairs of opposed side walls having a first arcuate configuration, a second pair of said at least two pairs of said opposed side walls having a second arcuate configuration, said first pair of said opposed side walls being more flexible than said second pair of opposed side walls, wherein said first pair of opposed side walls can be flexed to compress against the liner to expel air from the liner, while said second pair of opposed side walls, being relatively more rigid than said first pair of opposed side walls, remains relatively non-flexed to maintain the strength of the holder.

29. A holder for a disposable liner, comprising a body for receiving the liner, said body having at least a first and a second pair of opposed side walls, a bottom and an open top, said bottom having at least one air vent for movement of air into and out of said body, said first pair of opposed side walls being more flexible than said second pair of opposed side walls, wherein said first pair of opposed side walls can be flexed to compress against the liner to expel air from the liner, while said second pair of opposed side walls, being relatively more rigid than said first pair of opposed side walls, remains relatively non-flexed to maintain the strength of the holder.

30. The holder of claim 29, wherein said body is tapered from said open top to said bottom, so that said bottom has a smaller diameter than said open top.

31. The holder of claim 29, wherein said side walls of said first and second pairs of opposed side walls are arcuate when viewed in horizontal section, and said bottom has a rectilinear shape.

32. The holder of claim 31, wherein said body has a circular rim that defines said open top.

33. The holder of claim 29, wherein the thickness of each side wall of said first pair of opposed side walls is different from the thickness of each side wall of said second pair of opposed side walls.

* * * * *